US006523607B2

(12) United States Patent
Watanabe et al.

(10) Patent No.: US 6,523,607 B2
(45) Date of Patent: Feb. 25, 2003

(54) MODULE-TYPE HEAT EXCHANGER AND METHOD OF MANUFACTURING THE SAME

(75) Inventors: Kazuhiro Watanabe, Hadano (JP); Hisae Nishikawa, Hadano (JP); Takashi Nohara, Hadano (JP)

(73) Assignee: Toyo Radiator Co., Ltd., Tokyo (JP)

( * ) Notice: Subject to any disclaimer, the term of this patent is extended or adjusted under 35 U.S.C. 154(b) by 4 days.

(21) Appl. No.: 09/967,349

(22) Filed: Sep. 28, 2001

(65) Prior Publication Data

US 2002/0050348 A1 May 2, 2002

(30) Foreign Application Priority Data

Oct. 31, 2000 (JP) ..... 2000-333992

(51) Int. Cl.[7] ..... F28F 9/04
(52) U.S. Cl. ..... 165/178; 29/890.03
(58) Field of Search ..... 165/153, 71, 72, 165/173, 175; 29/890.03, 890.052; 138/89

(56) References Cited

U.S. PATENT DOCUMENTS 2,644,978 A * 7/1953 Becker ..... 138/89
2,840,113 A * 6/1958 Simpson et al. ..... 138/89
3,814,135 A * 6/1974 Hetzer et al. ..... 138/89
4,308,652 A * 1/1982 Woodhull, Jr. ..... 165/175
4,944,977 A * 7/1990 Shantz et al. ..... 138/89
5,848,616 A * 12/1998 Vogel et al. ..... 138/89
5,924,485 A * 7/1999 Kobayashi et al. ..... 165/173
6,032,695 A * 3/2000 Wellen et al. ..... 138/89
6,283,156 B1 * 9/2001 Motley ..... 138/89
6,289,979 B1 * 9/2001 Kato ..... 165/173

* cited by examiner

*Primary Examiner*—Henry Bennett
*Assistant Examiner*—Terrell McKinnon
(74) *Attorney, Agent, or Firm*—Jordan and Hamburg LLP

(57) ABSTRACT

A header pipe 3 is prepared by severing an elongated round pipe to a desired length, forming an engagement recess 1 in the inner surfaces at opposite open ends, and forming a multiplicity of flat holes 2 in the peripheral surfaces. A flat tube 4 is inserted into each of the flat holes 2, with fins 5 fixedly secured to the outer surfaces thereof to thereby construct a core 6. End members such as the end portion of a port pipe 7 and an end cover 8 are fitted to the openings of the header pipe 3 by way of an O-ring 9 for sealing, to complete a module-type heat exchanger.

6 Claims, 5 Drawing Sheets

MODULE-TYPE HEAT EXCHANGER AND METHOD OF MANUFACTURING THE SAME

BACKGROUND OF THE INVENTION

1. Field of the Invention

The present invention relates to a module-type heat exchanger capable of coping with flexible manufacture and to a method of manufacturing the same.

2. Description of the Related Arts

A conventional mass production-type heat exchanger for cooling engine coolant has been constructed as seen in FIG. 10.

In this construction, both ends of flat tubes penetrate a pair of tube plates 18, with their penetrations being fixedly brazed to form a core, and members 12 are disposed on opposite end portions of the core. An open end of a tank body 19 is fitted to each tube plate 18, with the fitting portion being integrally brazed.

The tank body 19 has a port pipe 7, a filler neck 20 and a drain cock 16 mounted thereon.

Depending on various capacities and the conditions for sites to be mounted in automobiles, the heat exchangers for automobiles have had different widths and heights of the heat exchanger core and different positions and orientations of the port pipe and drain cock.

Separate molds were required for each different conditions to produce the heat exchangers corresponding to the design conditions. Such multiple molds resulted in higher production costs. In particular, among them, investments for molds of the tube plate 18 and the tank body 19 have caused a significant rise of the production costs. The design conditions for the heat exchangers have recently diversified more and more, which needs a flexible manufacture. Thus, the conventional method of manufacturing the heat exchanger has inevitably resulted in raised costs.

SUMMARY OF THE INVENTION

It is therefore the object of the present invention to provide a module-type heat exchanger capable of sharing as many components as possible so as not to incur a raised cost correspondingly to the flexible manufacture, and a method of manufacturing such a module-type heat exchanger.

In order to achieve the above object, according to a first aspect of the present invention, there is provided a module-type heat exchanger comprising a core, the core including a pair of header pipes each formed from a round pipe of a desired length and having engagement recesses previously formed in the inner surfaces at opposite open ends of the round pipe, the pair of header pipes each having a multiplicity of flat holes formed in parallel and at regular intervals in the peripheral surface, a multiplicity of flat tubes having opposite ends which are inserted into the flat holes, with their insertion portions being joined in a liquid tight manner, and a multiplicity of fins fixedly secured to the outer surface of each of the flat tubes; and end members such as end portions of a port pipe and an end cover which are fitted via O-rings for sealing to the openings of the header pipes in a liquid tight manner, wherein the end members at their fitting portions have outer peripheries which conform to the inner peripheries of the header pipes, the end members each including a claw formed protrusively on its outer periphery to be engaged with the engagement recess to provide a prevention of disengagement in the axial direction, and an annular recess formed in its outer periphery for receiving the O-ring.

In the module-type heat exchanger, the claw is preferably tapered in section to provide a disengagement prevention, with a space defined between the engagement recess and an opening edge of the header pipe being tapered toward the opening edge, and one or more claws and engagement recesses are preferably formed shorter than the perimeter in the circumferential direction so that they are prevented from rotating in the circumferential direction.

Preferably, a plurality of engagement recesses are arranged at regular intervals on the inner peripheral surface at the end portion of the header pipe, and the end member comprises at least a pair of port pipes, with the direction of extremity of the pipe being capable of selection in plural directions by the presence of the plurality of engagement recesses.

The header pipe may be produced by cutting an elongated round pipe, and the end member may be formed from a casting or an integral form of a synthetic resin.

In order to achieve the above object, according to a second aspect of the present invention there is provided a method of manufacturing the module-type heat exchanger, the method comprising the steps of severing an elongated round pipe having the same diameter to an appropriate length and cutting its inner surfaces at open ends and flat holes; making a core from the pair of header pipes of a desired length, flat tubes and fins; and preparing the end members such as the port pipes that conform to the inner surfaces at the open ends of the header pipe and fitting the end members to the opposite ends of the header pipe by way of O-rings for sealing in a liquid tight manner.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENT

A preferred embodiment of the present invention will now be described with reference to the accompanying drawings.

Figure 1:
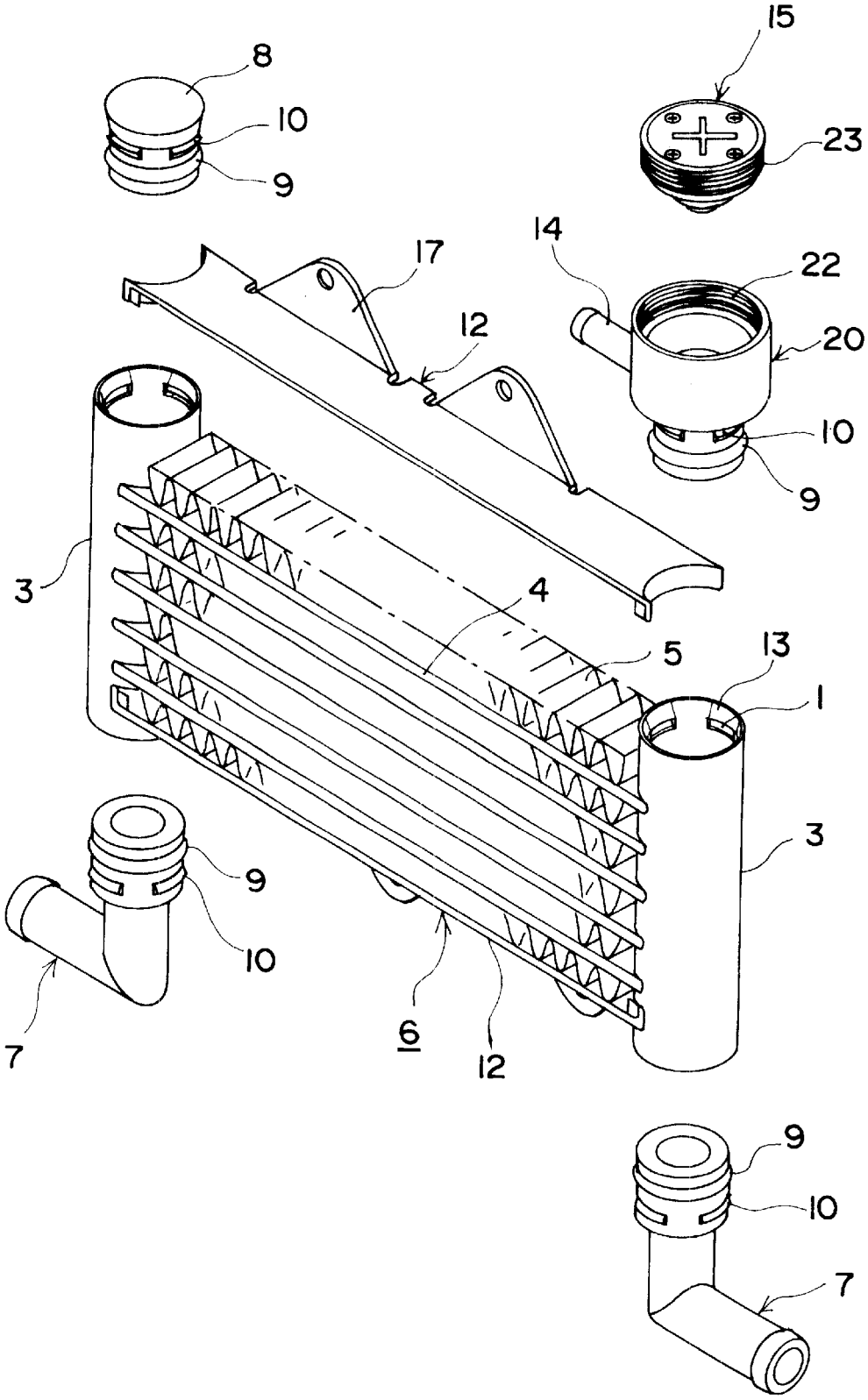
FIG. 1 is an exploded perspective view of a module-type heat exchanger in accordance with the present invention.
Figure 2:
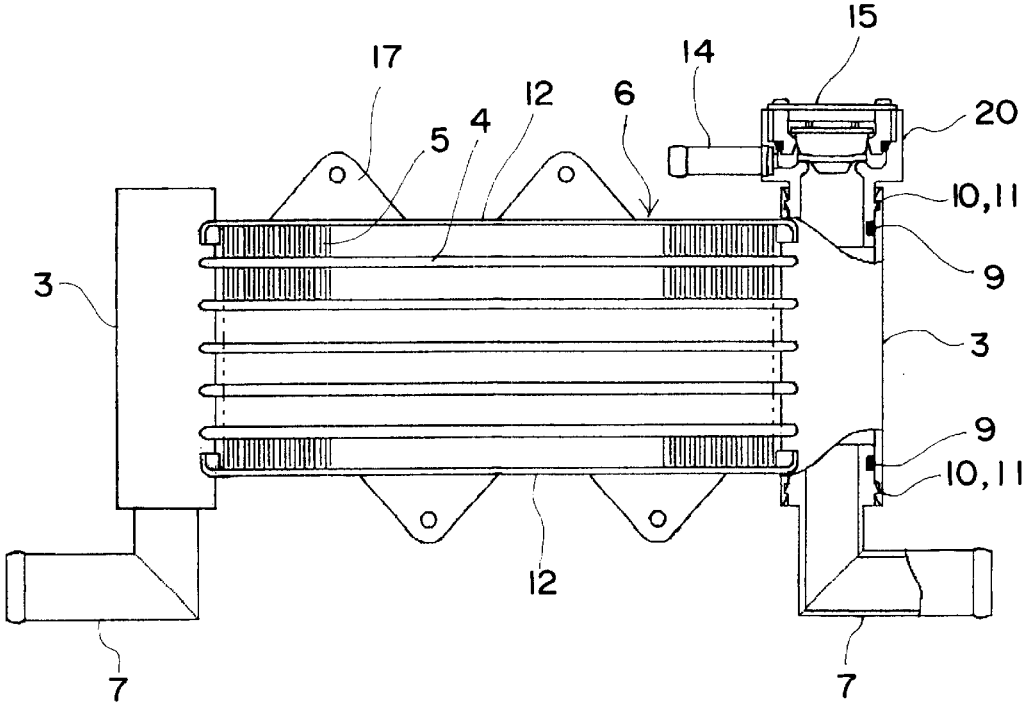
FIG. 2 is a partly cutaway front elevational view of the heat exchanger in its assembled state.
Figure 3:
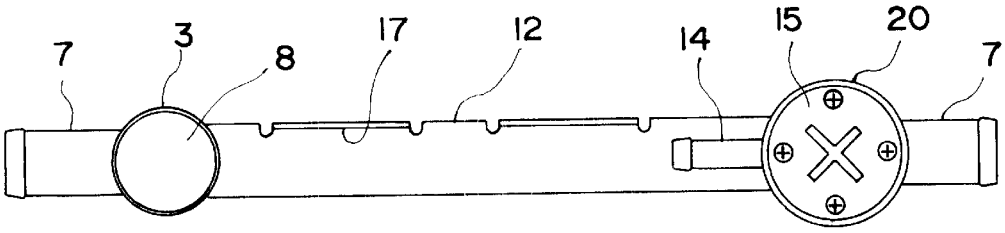
FIG. 3 is a top plan view of the heat exchanger.
Figure 4:
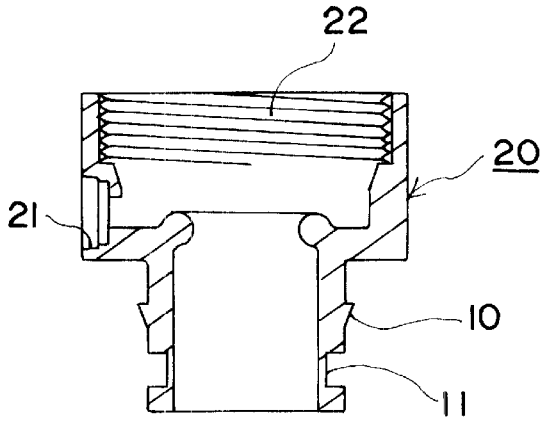
FIG. 4 is a longitudinal sectional view of a filler neck 20 for use in the heat exchanger.
Figure 5:
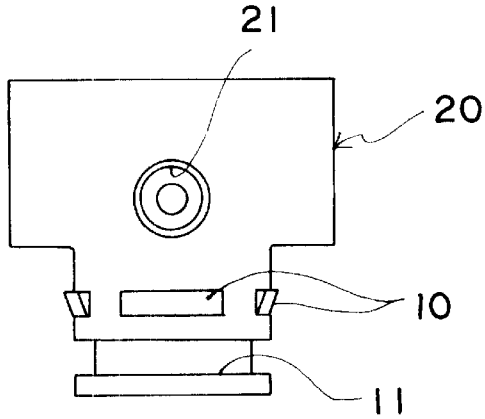
FIG. 5 is a front elevational view of the same.
Figure 6:
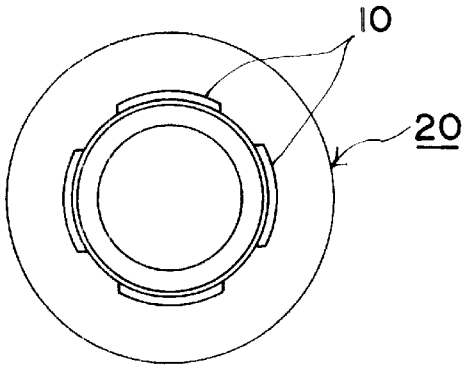
FIG. 6 is a bottom plan view of the same.
Figure 7:
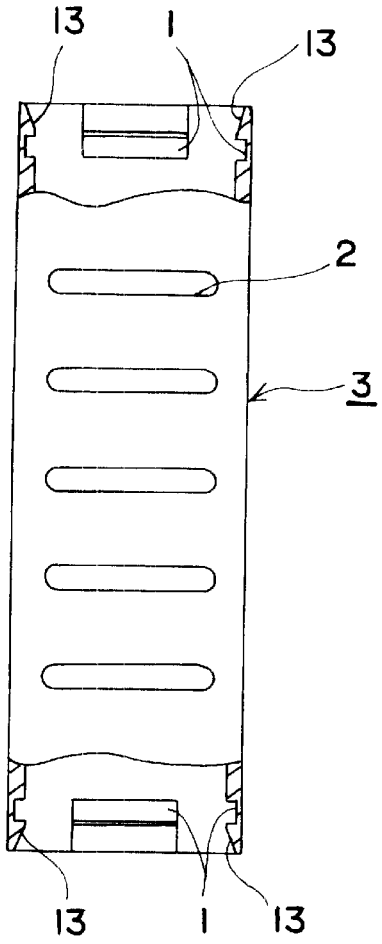
FIG. 7 is a partly cutaway front elevational view of a header pipe 3 for use in the module-type heat exchanger of the present invention.
Figure 8:
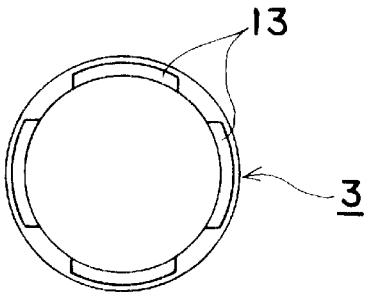
FIG. 8 is a top plan view of the same.

FIG. 1 is an exploded perspective view of a heat exchanger in accordance with the present invention, FIG. 2 is a front elevational view of the same in its assembled state, FIG. 3 is a top plan view of the same in its assembled state, FIG. 4 is a longitudinal sectional view of a filler neck 20 for use in the heat exchanger, FIG. 5 is a front elevational view of the same, and FIG. 6 is a bottom plan view of the same. FIG. 7 is a partly cutaway front elevational view of a header pipe 3 for use in the heat exchanger of the present invention, and FIG. 8 is a top plan view of the same.

Referring to FIGS. 1 to 7, the header pipe 3 is formed by severing an elongated round pipe to a predetermined length, cutting its opposite open ends and equidistantly forming a multiplicity of flat holes 2 on its outer periphery. The open ends of the header pipe 3 have on their inner peripheral surfaces four circumferentially elongated engagement recesses 1 which are arranged equiangularly by 90 degrees. The engagement recess 1 is U-shaped in longitudinal section and has a tapered surface 13 for claw guidance which is tapered from the edge of U toward the open edge.

A flat tube 4 is formed by severing an elongated electrically-seamed tube to a predetermined length and its opposite ends are inserted into the flat hole 2 of the header pipe 3. Fins 5 are arranged between adjacent flat tubes 4, with members 12 disposed at opposite edges of the flat tubes 4 in their juxtaposed direction to assemble a core. The core is loaded into a high-temperature furnace so as to melt and then solidify a brazing material previously coated on the surfaces of components or the brazing material intervening between the components, to finally obtain an integrated core 6.

In this example, a pair of port pipes 7 acting as end members prepared in advance are mounted on the finished core 6 from below of the corresponding header pipes 3, with the filler neck 20 fitted to the upper end of one of the header pipes 3, and with an end cover 8 fitted to the upper end of the other of the header pipes 3, to finish a heat exchanger.

The end members have on their one end side just the same outer peripheral geometries. More specifically, the outer peripheries on one end side of the members are each provided with an annular recess 11 and a claw 10 of the same geometries. An O-ring 9 for sealing is fitted to the annular recess 11 so as to thereby provide a liquid tight seal with the header pipe 3. The claw 10 is fitted to the engagement recess 1 through the tapered surface 13 to provide a disengagement prevention in the axially outward direction and a rotation stop in the circumferential direction.

As seen in FIGS. 4 to 6, the claw 10 protrudes by way of example around the neck outer periphery of the filler neck 20 and meshes with the engagement recess 1 of the header pipe 3. The claw 10 is tapered in transverse cross section such that the taper is guided along the tapered surface at the edge inner surface of the header pipe 3.

The filler neck 20 has an internal thread 22 formed on its inner periphery and has a hole 21 formed in its outer periphery. A small-sized pipe l4 is brazed fixedly to the hole 21 as shown in FIG. 1. In this example, the filler neck 20 is formed from a casting of aluminum or the like. Alternatively, it may be formed from a mold of synthetic resin. In this case, the filler neck can be molded integrally with the small-sized pipe. The internal thread 22 of the filler neck 20 threadedly receives an external thread 23 which is formed on the outer periphery of a pressure cap 15.

Similarly, the end cover 8 and the port pipe 7 can be formed from a casting or a synthetic resin mold. The claw 10 and the annular recess 11 on their outer peripheries are also formed in just the same manner as the filler neck 20.

Figure 9:
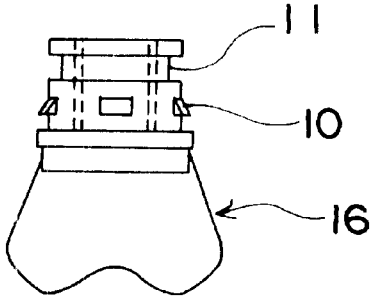
FIG. 9 is a front elevational view of a drain cock 16 for use in the module-type heat exchanger of the present invention.
Figure 10:
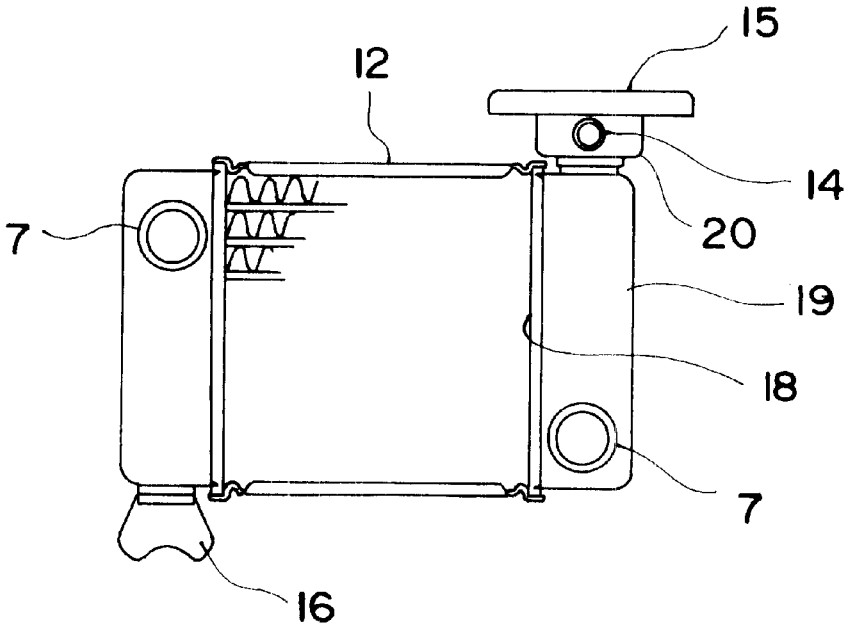
FIG. 10 Prior Art
FIG. 10 is a front elevational view of a conventional heat exchanger.

In this example, the end cover 8 is fitted to the upper end of the left-hand header pipe 3, with the port pipe 7 fitted to the lower end thereof. Alternatively, the port pipe 7 may be fitted to the upper end of the left-hand header pipe 3, and a drain cock 16 shown in FIG. 9 may be fitted to the lower end thereof. The drain cock 16 also has at its fitting portion the claw 10 and the annular recess 11 which are formed in advance. The annular recess 11 receives the O-ring 9 for sealing, which in turn is fitted to the header pipe 3.

It is to be noted that the axial direction of the port pipe 7 and the axial direction of the small-sized pipe 14 can be oriented toward a desired direction upon fitting by selecting one of four 90-degree different directions.

Among such components, the member 12 is produced and prepared for each different width of the core 6. The header pipe 3 is severed and produced to a required length from an elongated pipe material as described above. The other components are in advance prepared as ones having fitting portions which conform to the header pipe 3.

In this manner, according to the heat exchanger of the present invention, it is possible to produce heat exchangers having variously different widths and heights and to appropriately select the port pipe 7, the filler neck 20, the end cover 8, the drain cock 80, etc., for use with the heat exchangers. Thus, there can be provided a heat exchanger having a high degree of freedom in design and requiring less costs for molds.

According to the module-type heat exchanger of the present invention, the engagement recess 1 is previously formed in the opposite open ends of the pair of header pipe 3 making up the core 6 and receives the end members such as the port pipe 7 and the end cover 8 via the O-ring in a liquid tight manner, whereby the claw 10 protrusively provided on the outer periphery of the end member can engage with the engagement recess 1 for prevention of disengagement. It is thus possible to easily share the end members and to provide heat exchangers having variously different capacities by varying the length of the header pipe 3.

In the event of arranging a plurality of engagement recesses 1 at regular intervals along the end inner peripheral surface of the header pipe 3, it is possible to arbitrarily select the axial direction of the port pipe when fitting the port pipe thereto and to provide a module-type heat exchanger having a high degree of freedom.

According to the method of manufacturing the module-type heat exchanger of the present invention, it is possible to effect a flexible manufacture of the heat exchangers at a low cost with a less investment in molds for components.

While illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A module-type heat exchanger comprising:

a core; said core including a pair of header pipes each formed from a round pipe of a desired length and having engagement recesses previously formed in the inner surfaces at opposite open ends of said round pipe, said pair of header pipes each having a multiplicity of flat holes formed in parallel and at regular intervals in the peripheral surface;

a multiplicity of flat tubes having opposite ends which are inserted into said flat holes, with their insertion portions being joined in a liquid tight manner; and a multiplicity of fins fixedly secured to the outer surface of each of said flat tubes; and end members and an end cover which are fitted via O-rings for sealing to the openings of said header pipes in a liquid tight manner, wherein said end members at their fitting portions have outer peripheries which conform to the inner peripheries of said header pipes, said end members each including a claw formed protrusively on its outer periphery to be engaged with said engagement recess to provide a prevention of disengagement in the axial direction, and an annular recess formed in its outer periphery for receiving said O-ring.

2. The module-type heat exchanger according to claim 1, wherein said claw is tapered in section to provide a disengagement prevention, with a space defined between said engagement recess and an opening edge of said header pipe being tapered toward said opening edge, and wherein one or more claws and engagement recesses are formed shorter than the perimeter in the circumferential direction so that they are prevented from rotating in the circumferential direction.

3. The module-type heat exchanger according to claim 2, wherein a plurality of engagement recesses are arranged at regular intervals on the inner peripheral surface at the end portion of said header pipe, and wherein said end member comprises at least a pair of port pipes, with the direction of extremity of said pipe being capable of selection in plural directions by the presence of said plurality of engagement recesses.

4. The module-type heat exchanger according to any one of claims 1 to 3, wherein said header pipe is produced by cutting an elongated round pipe, and wherein said end member is formed from a casting or an integral form of a synthetic resin.

5. The module-type heat exchanger according to claim 1, wherein said end members comprise end portions of a port pipe.

6. A method of manufacturing a module-type heat exchanger according to any one of claims 1 to 3 and 5, said method comprising the steps of:

severing an elongated round pipe having the same diameter to an appropriate length and cutting its inner surfaces at open ends and flat holes;

making a core from said pair of header pipes of a desired length, flat tubes and fins; and preparing said end members that conform to the inner surfaces at the open ends of said header pipe and fitting said end members to the opposite ends of said header pipe by way of O-rings for sealing in a liquid tight manner.

* * * * *